United States Patent [19]

Bryan

[11] 3,968,857

[45] July 13, 1976

[54] DEVICE FOR PREVENTING UNAUTHORIZED ACCESS TO PERMANENT LADDERS

[76] Inventor: Robin R. Bryan, 5007 Orchard Ridge Lane, Greensboro, N.C. 27405

[22] Filed: Feb. 20, 1975

[21] Appl. No.: 551,076

[52] U.S. Cl. ..... 182/106; 182/47; 182/77; 182/230

[51] Int. Cl.[2] ..... E06C 5/32

[58] Field of Search ..... 182/106, 230, 206, 129, 182/47, 77

[56] References Cited

UNITED STATES PATENTS

| | | | |
|---|---|---|---|
| 2,880,829 | 4/1959 | Watkins | 182/47 |
| 3,106,986 | 10/1963 | Ray | 182/106 |
| 3,225,863 | 12/1965 | Ludlow | 182/230 |

*Primary Examiner*—Reinaldo P. Machado

[57] ABSTRACT

A shield having a front plate and a pair of side flanges extending rearwardly and outwardly therefrom to a point substantially adjacent a supporting wall or beam substantially encases the ladder and prevents unauthorized use of the ladder. The length of the shield may be considerably reduced by attaching the shield to the ladder at a point above the ground. The front plate is hingedly attached to one of the side flanges and a locking device adjustably mounted on the rungs of the ladder secures the front plate in closed relationship to the face thereof.

5 Claims, 4 Drawing Figures

DEVICE FOR PREVENTING UNAUTHORIZED ACCESS TO PERMANENT LADDERS

BACKGROUND OF THE INVENTION

The owners of storage tanks, smoke stacks, television towers, tall buildings and other storage bins and silos subject themselves to possible liability resulting from unauthorized use by children of the permanent ladders secured thereto. Where a child wanders onto the property on which a storage tank or silo is located, and is injured while climbing the ladder, the owner of the property may be liable. Therefore there is a need for some type of safety shield for preventing unauthorized use of the ladder.

Home-made devices for keeping children off such ladders have been used such as barbed wire wrapped around the lower rungs of the ladder, or a heavy object laid against the lower rungs of the ladder which children cannot move. The disadvantages to such types of makeshift shields are that it is sometimes difficult and time consuming for an authorized person to remove the shield so that he may ascend the ladder.

One known prior art reference which discloses an attempt to overcome such a problem is the U.S. Patent to Ludlow No. 3,225,863 where in FIG. 3, there is shown a hinged cover plate for fire escapes. This approach to the solution falls short of the mark, however, for several reasons. First of all, the safety shield does not extend around the side and rear of the ladder, so that a person having some ingenuity can reach around the safety shield and grab hold of the rungs of the ladder and pull himself up to a point above the top edge of the safety shield.

Secondly, the shield is attached to the ladder at or adjacent the ground, and it is an easy matter for one child to stand on the shoulders of another and gain access to the rungs of the ladder above the shield. If the shield were lengthened to such an extent as to prevent such unauthorized use, it would become very heavy, expensive, and difficult to install and use.

Finally, while a shield such as that shown by Ludlow may be easily installed during the initial construction of the fire escape, and the fire escape and shield may be so constructed as to be compatible with each other, there is needed a shield which is adapted to be installed on substantially all of the existing types of ladders in use today. Such ladders vary in width between side rails, distance between the rungs, and spacing between the ladder face and the support surface to which it is attached. Therefore, the hardware by which the ladder is installed must be extremely flexible, since hardware that is constructed to fit one type of ladder, may not fit any other type of ladder.

The owner of a storage tank or tower is not going to be interested in using a safety shield that is very difficult and expensive to install, as for example, if he has to send a welding team out to the site to make the installation.

SUMMARY OF THE INVENTION

The present invention, on the other hand is directed to a safety shield which may be installed on substantially all types of existing permanent, vertical ladders, such as those installed on storage tanks, stacks, radio and television towers, bins and silos and tall buildings. In this regard, first of all, the hardware associated with the shield of the present invention is of a type which includes brackets adapted to be secured to the rungs and rails of the ladder, and mount the shield thereto, whereby the shield may be installed on the ladder in one of several locations.

The shield includes not only a hinged front plate which may be selectively locked in a closed position, or unlocked and opened, but also rearwardly and angularly directed side flanges which extend to a point substantially adjacent the support surface, such as the bin or silo wall. When the front plate is closed, the shield with its side flanges and the support surface substantially enclosed the entire ladder, so that children are prevented access from either the front, sides, or rear thereof.

Finally, the shield according to the present invention is attached to the ladder at a point with its bottom edge approximately ten feet above the ground, so that it effectively prevents children from climbing to sufficiently high points on the ladder to injure themselves, yet may be constructed with a minimum of material and expense, as the length of the shield does not have to be extremely long to prevent use of the ladder at points above 8 to 10 feet. It is felt that the use of the lower portions of the ladder (under 10 feet) are not substantially as hazardous as is the case with the upper portions of the ladder.

It is therefore an object of the present invention to provide an improved safety shield for existing, permanent, vertically extending ladders which combines the characteristics of maximum protection with minimum expense and size.

It is further an object of the present invention to provide a safety shield for ladders of the type described which substantially encloses the ladder and prevents access to either the front, sides, or rear thereof.

It is yet another object of the present invention to provide a safety shield for ladders of the type described which is compatible for installation on substantially all existing ladders, wherein the mounting hardware is standardized to mount on most types of existing ladders.

Other objects of the invention will become apparent upon reading the following specification in view of the enclosed drawings, in which.

Figure 2:
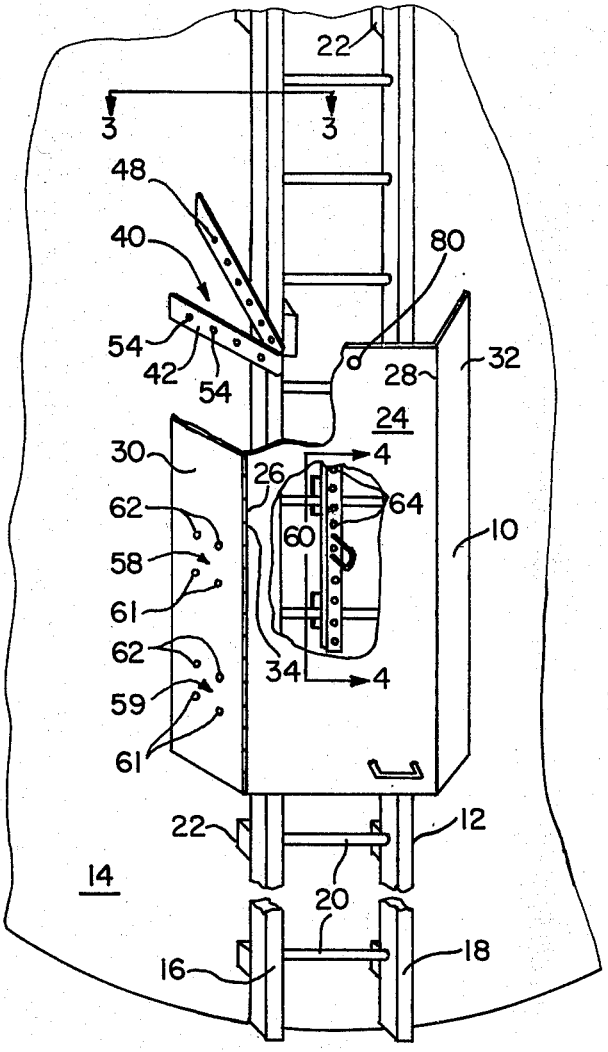
FIG. 2 is a perspective view, with parts broken away for the sake of clarity, illustrating the safety shield according to the present invention installed on a permanent ladder.
Figure 1:
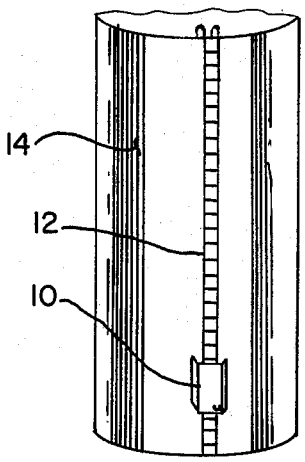
FIG. 1 is a perspective view illustrating a conventional storage tank and permanent ladder of the type with which the shield of the present invention is used.

Turning now to the drawings, and first of all to FIGS. 1 and 2, the safety shield 10 according to the present invention is adapted for use with existing permanent, vertical ladders 12 of the type used in connection with storage tanks, watertanks, smoke stacks, t.v. towers, tall buildings, bins and silos. In this regard, the ladder 12 is permanently affixed to a wall or support surface 14 of the supporting structure in close proximity thereto so that a person cannot climb up the back side of the ladder. In some of these ladders, however, sufficient space exists between the support surface and the ladder, or else the support surface is of such a sufficiently small diameter, so that a person with access to the side of the ladder might conceivably be able to mount atop a safety shield that merely extends across the front of the ladder as shown by the Ludlow patent referred to hereinabove.

The ladder 12 with which the present invention is utilized, as best illustrated in FIG. 2, is of the type which comprises a pair of vertically extending rails 16,18 connected by a plurality of parallel, horizontally extending rungs 20. The side rails 16,18 are permanently secured to the supporting structure 14 by means of gussets or plates 22 which are welded or otherwise permanently secured to both the support structure 14 and rails 16,18.

Turning now to a description of the safety shield 10, which is the subject of the present invention, a front plate 24 having longitudinal side edges 26,28 further includes a pair of side flanges 30,32, each of which is attached to one of said side edges 26,28 and extends rearwardly and outwardly therefrom in angular relationship thereto. A hinge means 34 connects side flange 30 with front plate 24, so that the front plate is selectively movable between a first, open position and a second, closed position. Whereas side flange 30 is formed as a separate member, side flange 32, may be formed by bending a longitudinal side portion of front plate 24 to a prescribed angle.

Side flange 30 is secured to rail 16 of the ladder by means of a plurality of connecting means 40. A locking means 60 is secured to the rungs 20 of ladder 12 and provides a means for securing said front plate 24 and the other side flange 32 in the closed position when the ladder is not in use by an authorized person.

The front plate 24 is horizontally adjustable with respect to the face of ladder 12, as described hereinafter, so that in mounting, the shield may be moved toward or away from the face of ladder 12 and support structure 14 to position the free edges of side flanges 30 and 32 as near to the surface of the support structure 14 as possible. As described hereinabove, this prevents access to the sides and rear edge of the ladder, so that a child or unauthorized user cannot use this portion of the ladder to boost themselves above the top edge of the safety shield to reach the upper portions of the ladder, which are considered to be the dangerous positions. Further, the safety shield 10 is mounted approximately 10 feet above the ground, i.e., the lower edge of front plate 24 is approximately 10 feet above the ground. The shield itself is approximately 8 feet long, so that the top edge of the safety shield is approximately 18 feet above the ground, which prevents the normal child, either alone or with others, from being able to scale above the safety shield. Further, because the lower edge is 10 feet from the ground, the shield may be manufactured with a minimum of material and weight. This considerably reduces the cost, as well as facilitating the installation, since it is much easier to install a shield if it is lighter and smaller. For that matter, it is anticipated that the shield according to the present invention can be assembled by a single person as will be explained hereinbelow.

The face of such permanent ladders are normally installed at a distance of approximately 4 to 6 inches from the surface of the supporting structure onto which they are mounted. With this in mind, side flanges 30 and 32 are of such a length and extend rearwardly at such an angle that the shield 10 may be adjusted toward and away from the face of the ladder as necessary to position the free edges of the flanges substantially adjacent the surface of the supporting structure without substantially increasing the distance between the front plate 24 and the face of the ladder. This relationship holds true regardless of the width of the ladder, which may vary from 10 to 18 inches, depending on the type of ladder. With these variances in mind, it has been found that preferably the front plate 24 should have a width of approximately 18 inches, while the side flanges should have a width of approximately 9 inches. Also, the side flanges should be connected to the front plate 24 at an angle of approximately 45°. Such a construction has been found to adapt the safety shield for use with substantially all types of permanent ladders for such storage tanks as have been found over the last 50 years.

Figure 3:
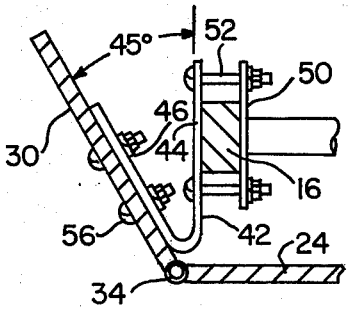
FIG. 3 is a sectional view taken substantially along line 3—3 in FIG. 2.

Turning now to FIGS. 2 and 3 and a discussion of the specifics of the connecting means 40, a strip of metallic stock of a suitable thickness is bent at approximately a 45° angle to form a bracket 42 including a first, bracket-to-ladder rail connecting arm 44 and a second, bracket-to-side flange connecting arm 46. A plurality of mounting holes 48 are formed in the arm 44, so that the bracket 42 may be adjustably mounted to move the shield toward or away from the surface of support structure 14. At a point along the length of side rail 16 where none of rungs 20 interfere, the bracket 42 is connected to the side rail by positioning a mounting plate 50 on the opposite side of the ladder rail from the arm 44. Mounting plate 50 includes a pair of holes spaced apart a distance corresponding to holes 48 in the arm 44. A pair of fastening elements 52 extend between arm 44 and plate 50 to firmly secure the bracket 42 to the ladder rail 16.

The bracket-to-side flange arm 46 is also provided with a pair of mounting holes 54, and of course, side flange 30 provided with correspondingly spaced holes 61,62. The flange 30 is secured to the bracket-to-flange connection length 46 by means of another pair of fastening elements 56. It whould be noticed that the side flange 30 includes two other mounting hole stations 58,59. Each of these mounting hole locations includes two pairs of openings 61,62 to make the mounting more flexible as described hereinbelow.

Figure 4:
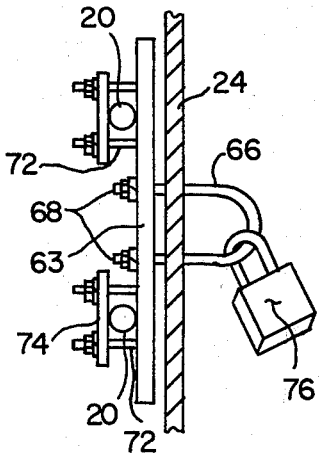
FIG. 4 is a sectional view taken substantially along line 4—4 in FIG. 2.

The locking means 60, as illustrated in FIG. 4, includes a support rod 63, formed of some suitable type of metallic bar or tube stock, having a plurality of perforations 64 extending therethrough at spaced positions along the length thereof. Support rod 63 is of a length greater than the distance between two adjacent rungs 20, and is preferably about 20 inches long. A hasp or eye-bolt 66 is secured by extending the free ends thereof through adjacent the perforations 64 and applying some type of securing means such as fastener nuts 68 to the ends thereof.

The support rod 63, itself, is secured to two adjacent rungs 20 of ladder 12 by means of fastening elements 72 which protrude through selected perforations 64 in the support rod 63 and cooperating openings in securing plates 74 on the opposite side of rungs 20. The front plate 24 includes a pair of slotted openings, not shown, arranged in transversely spaced positions on the face thereof, through which hasp 66 extends when the front plate 24 is in the closed position. A padlock or some type of locking device 76 may then be applied to the hasp or eye-bolt 66 for securing the safety shield.

Installation of the safety shield may be accomplished in the following manner. First of all three connecting brackets 42 are loosely attached to the side flange 30.

A lifting rope, not shown, is attached to a suitable portion of the safety shield 10, such as through opening 80 at the top of shield 10. The rope or cord is then looped across a rung above the point where the shield is to be attached, and the shield is raised to the approximate height on the ladder when it is to be installed. As indicated hereinabove, the most effective point of installation is approximately 10 to 15 feet above the ground. When the shield 10 is raised to that point, the rope is temporarily secured to a ladder rung to hold the shield approximately at the proper position.

The front plate 24 is then moved to its open position, and the top connecting or support bracket 42 on flange 30 is secured to the left ladder rail 16. The middle and lower support brackets 42 are subsequently mounted to side rail 16. If at one of these positions, a ladder rung offers an obstruction to the securing thereof, the support brackets may be moved to the alternate set of holes as set forth hereinabove and secured. After all brackets are loosely secured and properly located, all bolts are tightened to secure the side flange 30 to ladder rail 16.

Locking means support rod 63 is then loosely attached to two adjacent rungs 20, so that the lock eyelet or hasp 66 fits through one of the two slots, not shown, in the front plate 24 of the shield 10. The fasteners 72 are then tightened to secure the support rod 63 to the rungs, the shield is closed and the lock 76 applied.

During the step of securing brackets 42 to side rail 16, if the free edge of flanges 30,32 is too far away from the support structure 14 and/or the front plate 24 is too close or too far away from the face of the ladder, the brackets may be installed by using alternate holes 48 in bracket arm 44, thus effecting movement of the front plate 24 and side walls 30,32 toward or away from the face of the ladder or support structure.

Although the invention has been described with reference to a permanent ladder affixed to the side of storage tanks or a silo, it is obvious that the invention is equally adaptable for use with water tanks, t.v. towers, and the like. In such situations, it may be that the surface of the support structure does not extend outwardly from the side rails of the ladder, in which case the flanges 30,32 will merely extend rearwardly past the edges of the support structure surface, however the effect will still be to prevent access to the sides and rear portion of the ladder.

Also, it is obvious that various other changes and modifications may be made to the details of the construction without departing from the general spirit of the invention as set forth in the appended claims.

What is claimed is:

1. An improved safety shield for permanent ladders of the type having a pair of side rails and a plurality of rungs permanently secured to a support structure such as storage tanks, smoke stacks, television towers, tall buildings, bins and silos, said shield comprising:

a. a front plate having two longitudinal side edges;

b. a pair of side flanges, each of which extends rearwardly and outwardly from one of said side edges in angular relationship thereto to a point substantially adjacent said support structure;

c. a hinge means connecting a first of said side flanges and said front plate along juxtaposed side edges;

d. at least one support bracket for connecting said first side flange to said ladder, said first side flange substantially abutting said support structure;

e. said front plate being movable between a first open position and a second closed position wherein said front plate, side flanges, and supporting structure substantially enclose said ladder and the second side flange substantially abut said support structure to prevent unauthorized access thereto; and f. locking means for securing said front plate in said closed position.

2. The safety shield according to claim 1 wherein said shield is mounted on said ladder at a position intermediate the top and bottom thereof, rather than at the bottom.

3. The safety shield according to claim 1 wherein said support bracket includes mounting means associated herewith for adjustably mounting said bracket and said first side flange to said ladder, so that said shield may be adjustably spaced relative to the face of said ladder and said support surface.

4. The safety shield according to claim 3 wherein said support bracket comprises a first connecting arm and a second connecting arm disposed angularly to each other, said mounting means including a plurality of openings spaced along said first arm, and fastening means for connecting said first arm to said ladder through selected pairs of said openings, said first side flange being secured to said second arm of said support bracket.

5. The safety shield according to claim 1 wherein said front plate includes at least one slotted opening therein, said locking means includes a support rod having a hasp secured thereto, said locking bracket being adjustably mounted to the rungs of said ladder at one of a plurality of positions along the length of said support rod, whereby said hasp may be adjusted vertically with respect to said ladder rungs to align with said slotted openings in said front plate when said front plate is in said closed position.

* * * * *